US006555169B2

(12) United States Patent
Lynch

(10) Patent No.: US 6,555,169 B2
(45) Date of Patent: Apr. 29, 2003

(54) SYSTEM AND METHOD FOR MASKING DOOR HINGES DURING PAINTING

(75) Inventor: Marcus L. Lynch, Jacksonville, FL (US)

(73) Assignees: William Tenckhoff, Fallston, MD (US); Tracey Tenckhoff, Fallston, MD (US)

( * ) Notice: Subject to any disclaimer, the term of this patent is extended or adjusted under 35 U.S.C. 154(b) by 0 days.

(21) Appl. No.: 09/841,162

(22) Filed: Apr. 24, 2001

(65) Prior Publication Data

US 2002/0004103 A1 Jan. 10, 2002

Related U.S. Application Data

(60) Provisional application No. 60/199,494, filed on Apr. 25, 2000.

(51) Int. Cl.[7] ..... B05D 1/32
(52) U.S. Cl. ..... 427/282; 427/272
(58) Field of Search ..... 427/282, 272; 118/504, 505; 428/42.3, 352; 16/250, 251

(56) References Cited

U.S. PATENT DOCUMENTS

| | | | | |
|---|---|---|---|---|
| 3,961,602 | A | * | 6/1976 | Dresser |
| 4,420,520 | A | | 12/1983 | Jones et al. |
| 4,430,137 | A | * | 2/1984 | Jones |
| 4,691,409 | A | * | 9/1987 | Torgerson et al. |
| 4,713,274 | A | | 12/1987 | Minor |
| 4,796,330 | A | * | 1/1989 | Ziegler |
| 4,802,259 | A | | 2/1989 | Geslewitz |
| 5,056,191 | A | | 10/1991 | Love |
| 5,113,921 | A | * | 5/1992 | Pool |
| 5,198,031 | A | | 3/1993 | Derstine |

* cited by examiner

*Primary Examiner*—Fred J. Parker
(74) *Attorney, Agent, or Firm*—Allen, Dyer, Doppelt Milbrath & Gilchrist, P.A.

(57) ABSTRACT

A system and method for masking door hinges during painting uses distinct hinge masks, pin masks and barrel masks having a releasable adhesive and disposed on a transfer sheet in a unit arrangement.

18 Claims, 5 Drawing Sheets

SYSTEM AND METHOD FOR MASKING DOOR HINGES DURING PAINTING

RELATED APPLICATION

This nonprovisional application claims the priority date of copending provisional patent application Ser. No. 60/199,494 filed on Apr. 25, 2000, which is incorporated into this application by reference. The benefit of its earlier filing date is claimed under 37 C.F.R. §1.78(a)(4).

BACKGROUND OF THE INVENTION

1. Field of the Invention

The present invention relates generally to painting and more particularly relates to a system and method for masking door hinges while a door is being painted.

2. Description of the Prior Art

The prior art discloses a number of techniques for masking door hinges and related hardware during painting. The following patents are of interest: U.S. Pat. No. 4,420,520 to Jones et al.; U.S. Pat. No. 4,921,028 to Schwartz; U.S. Pat. No. 2,210,233 to De Lillo; U.S. Pat. No. 4,795,669 to Bowskill et al; U.S. Pat. No. 4,802,259 to Geslewitz; U.S. Pat. No. 2,996,041 to Carpenter et al; U.S. Pat. No. 2,045,597 to Haug; U.S. Pat. No. 3,752,304 to Alef; U.S. Pat. No. 3,961,602 to Dresser; and U.S. Pat. No. 4,263,355 to Sarkisian.

SUMMARY OF THE INVENTION

The present invention contemplates a system and an associated method for masking door hinges and related hardware during painting using multiple parts which are employed together to mask the hinge pin and then the hinge plates, in such a manner that once the painting is completed, the combination of the pin mask and the hinge masks may be easily and quickly removed by pulling away a tab associated with the component first applied, i.e., the pin mask. For these purposes, the term "hinge pin" refers to that portion of a hinge barrel between the hinge plates, in contrast to the "hinge barrel" which protrudes away from the hinge and away from the door jamb. It will of course be understood by those skilled in the art that the term "hinge pin" otherwise refers to the pin extending through the inside of the interleaved barrel portions of the hinge.

An important feature of the present invention is the utilization of relatively inexpensive components of the system which can be easily disposed upon a transfer sheet so that the pin mask and hinge masks may be removed from the transfer sheet in a facile manner. Additionally, the masks are arranged on the transfer sheet in units with a perforation in the sheet between adjacent units.

In another embodiment, the present invention also contemplates the use of a barrel mask with each unit to cover the barrel portion of the hinge as the opposing side of the door is being painted.

DETAILED DESCRIPTION

A preferred embodiment of the system and method of the present invention will now be described with reference to FIGS. 1–4.

Figure 1:
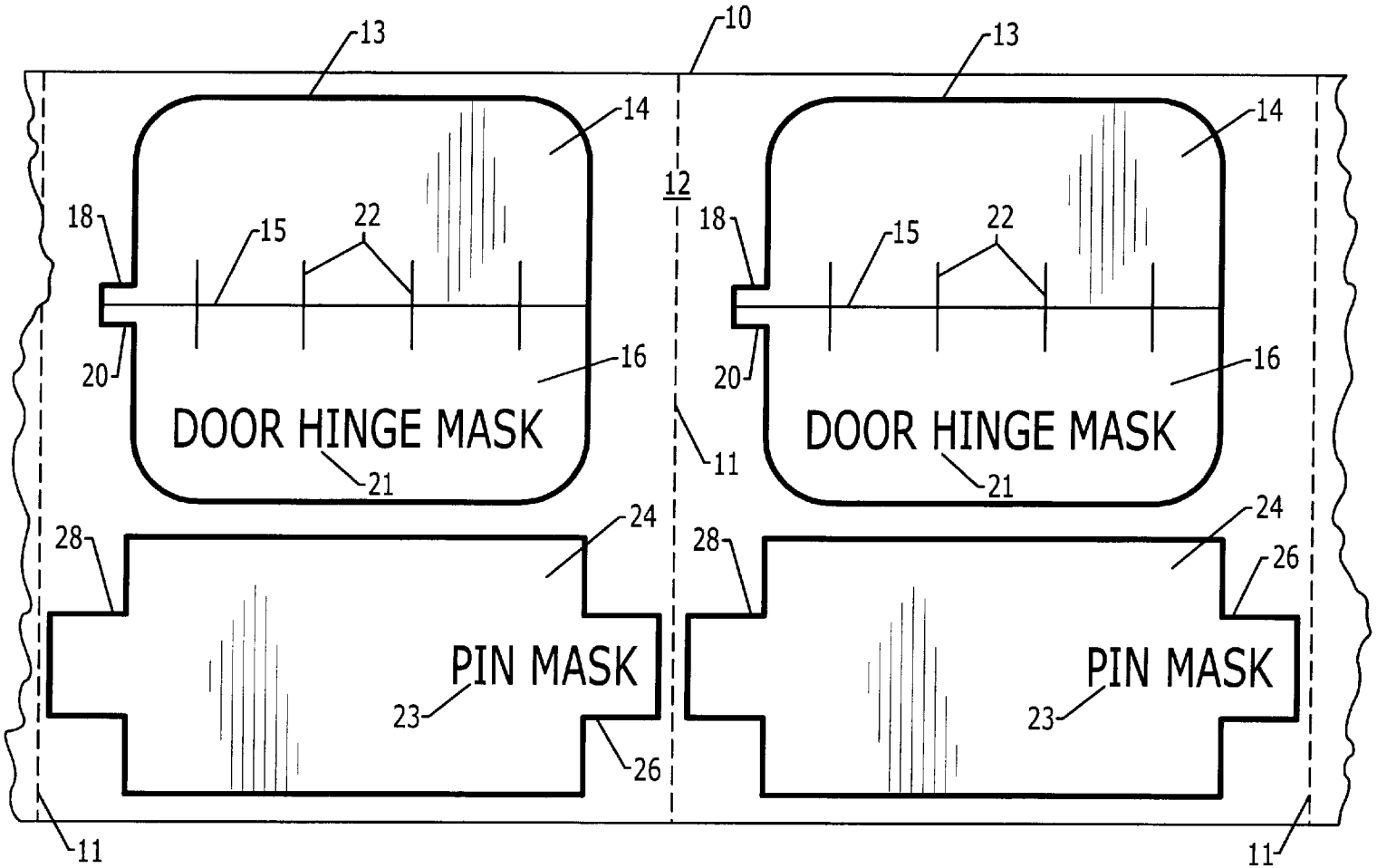
FIG. 1 is a top plan view of a transfer sheet having disposed thereon the various components associated with the system and method of the present invention for masking door hinges during painting.

Noting FIG. 1, a continuous web having an upper, non-adhesive surface 12 is provided as a continuous sheet 10, with lateral perforations 11 spaced along the transfer sheet 10 to permit individual units 13 to be torn away.

Disposed upon the surface 12 of the transfer sheet 10 are the various components of the system of the present invention, including opposing door hinge masks 14, 16 which are separated by a completely severed line 15 and each of which has at least one respective extending tab 18, 20 extending from one side thereof. The hinge masks 14, 16 are provided with striations 22 between the sides which permit the hinge masks to be properly aligned over a hinge plate and with respect to each other. Also disposed upon the surface 12 of the transfer sheet 10 are plural pin masks 24, each of which has opposing extending tabs 26, 28. It will of course be understood by those skilled in the art that the size and shape of the hinge masks 14, 16 and the pin masks 24 are such as to be able to accurately cover the hinges which are to be protected from painting. Most such hinges are of a common size, but to the extent that different sizes are employed the size and dimensions of the mask may likewise be altered. Further, since the masks 14, 16 and 24 are of a thin sheet material, they may be trimmed to a desired size with scissors. It is also preferred that appropriate printing 21, 23 be affixed to the upper surface of each mask 14, 16 and 24, so as to identify the type of mask (i.e., HINGE MASK or PIN MASK; similarly, as shown in FIG. 5, there is printing for the BARREL MASK). In the example of FIGS. 1–4, two hinge masks 14, 16 and one pin mask 24 is provided with each unit separable by the perforations 11.

Figure 3:
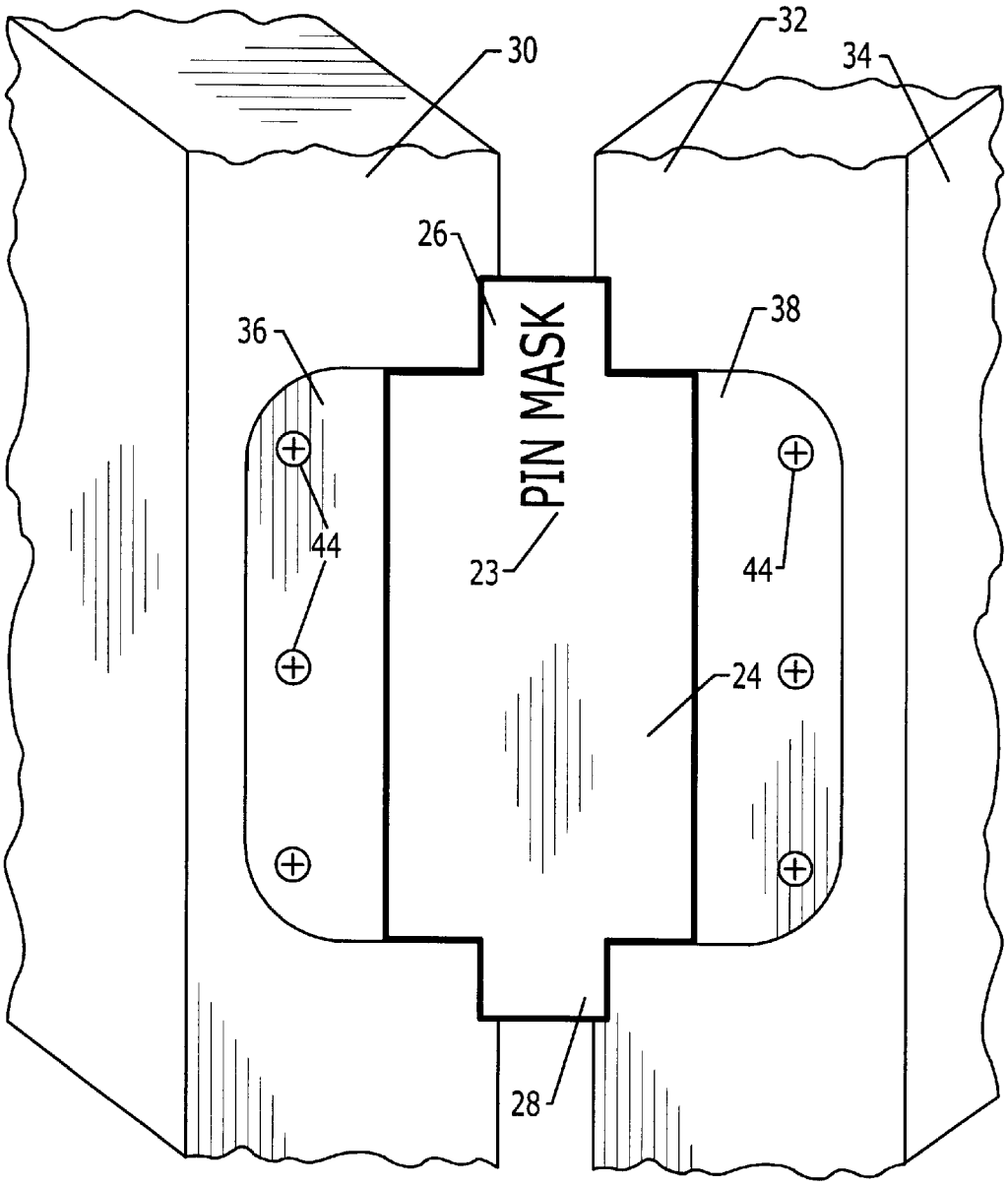
FIG. 3 is a front view like that shown in FIG. 2, illustrating a first step of the method of the present invention wherein a pin mask is removed from the transfer sheet shown in FIG. 1 and placed across the pin portion of the hinge as a painting mask.
Figure 4:
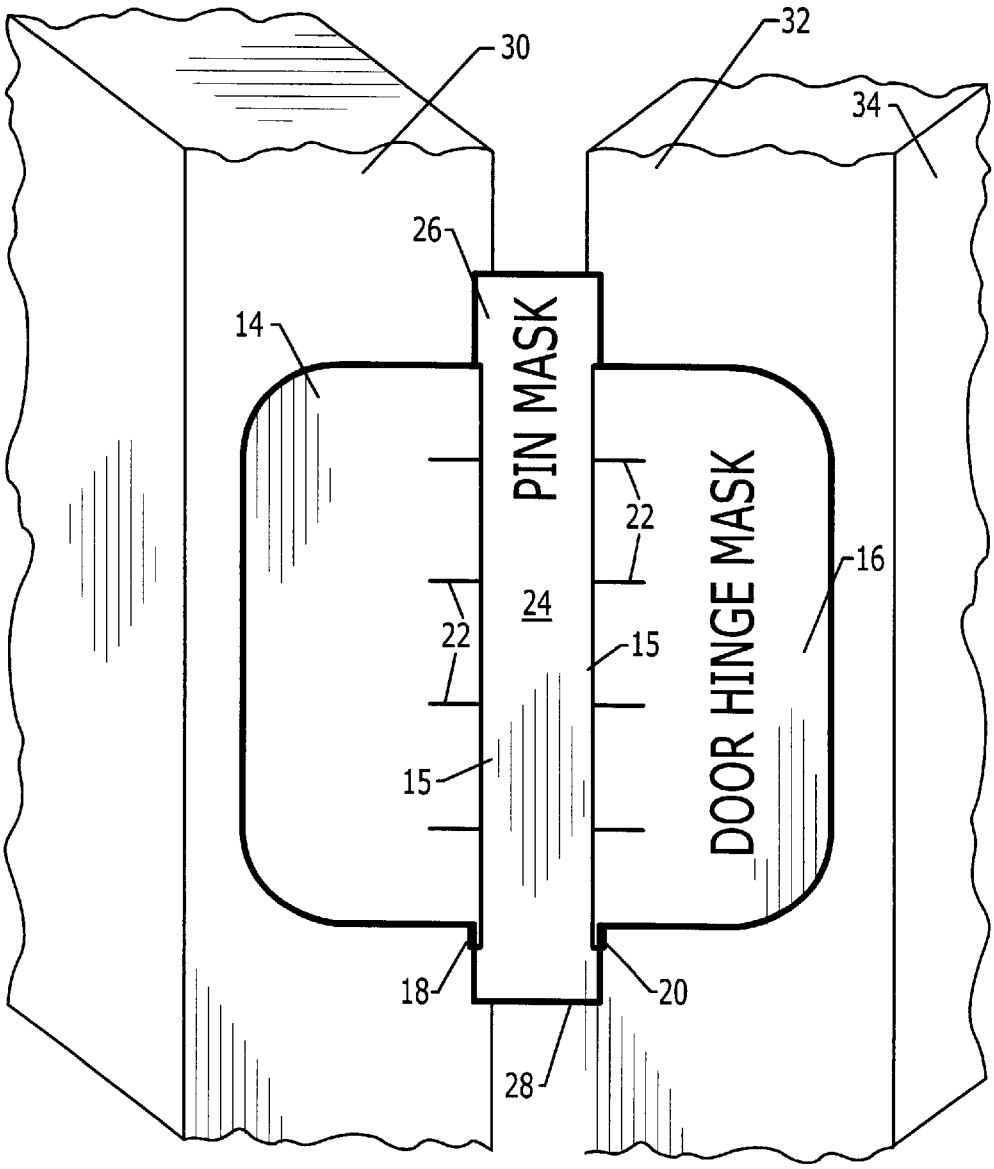
FIG. 4 is a front view of the door hinge of FIG. 2, illustrating another step in the method of the present invention wherein opposing door hinge masks are placed across the hinge plate portions of the hinge depicted in FIG. 2.
Figure 5:
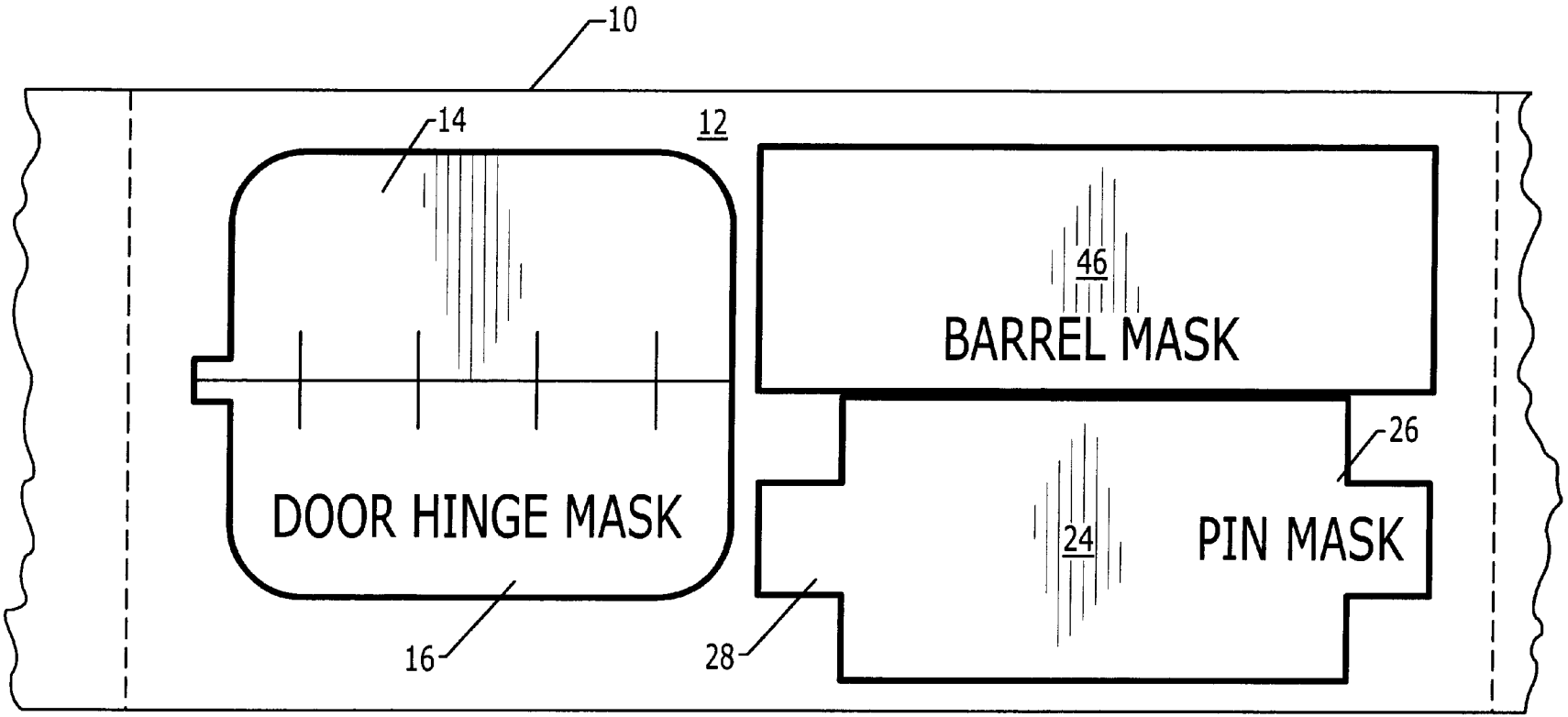
FIG. 5 is a top plan view of another arrangement of components useful with the system and method of the present invention as disposed upon a transfer sheet.

As will be better understood from the description of FIGS. 3 and 4, each mask 14, 16 and 24 is provided with a releasable adhesive on the inside surface, which permits each mask to be easily removed from the surface 12 of the transfer sheet 10 but which readily adheres to a metal surface, such as that used for hinges and hinge pins.

Figure 2:
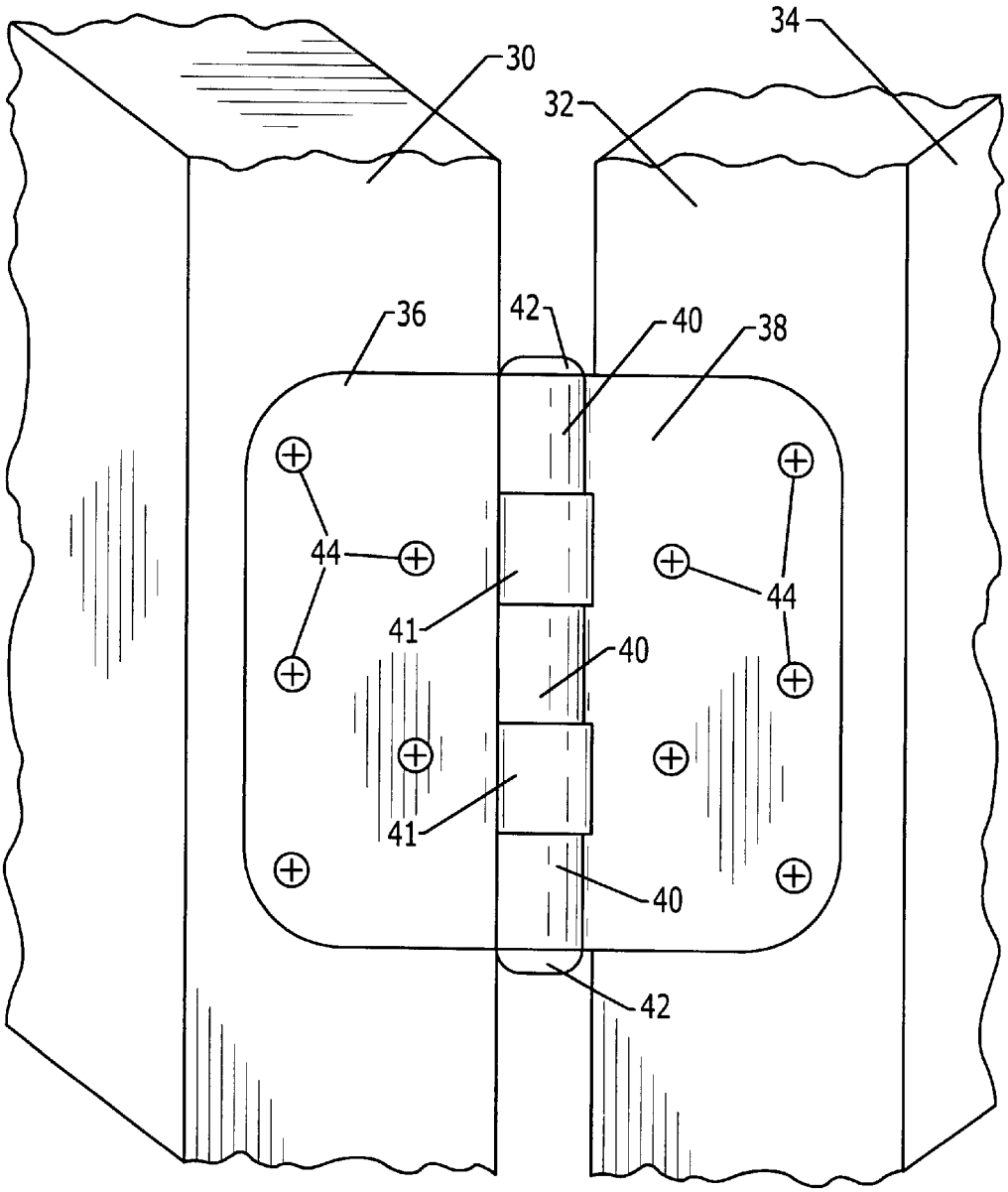
FIG. 2 is a front view of a conventional door hinge for rotatably joining a door with a door jamb.

A conventional hinge is shown in FIG. 2 for pivotally connecting a door 30 to a door jamb 32 adjacent a wall 34. The hinge comprises a pair of opposing hinge plates 36, 38 and interleaved hinge barrel portions 40, 41 and hinge pin 42 extending through the barrel portions 40, 41. Plural fasteners 44 attach the hinge plates 36, 38 to the respective inner surface of the door 30 or the door jamb 32.

FIG. 3 illustrates the door hinge of FIG. 2 after accomplishing a first step of the method of the present invention, in which a pin mask 24 is extended across the pin between the hinge plates 36, 38 such that the tabs 26, 28 extend outwardly from the pin so as to provide a means by which the pin mask 24 may be quickly removed.

Now noting FIG. 4, the door hinge masks 14, 16 are placed over the respective hinges and in overlapping relationship with the pin mask 24. The painter then completes the painting task, following which the pin mask 24 and the door hinge masks 14, 16 may be easily removed by quickly tearing away the pin mask 24 via one of the extending outward tabs 26, 28. It will of course be understood that the hinge masks 14, 16 may be placed first, followed by the pin mask 24.

In a second arrangement as shown in FIG. 5, the system is provided with an additional component in the form of a barrel mask 46. The barrel mask 46 may be wrapped about the barrel outside of the hinge during painting. In FIG. 5, one barrel mask 46 is associated with each unit.

This concludes the description of the preferred embodiments. A reading by those skilled in the art will bring to mind various changes without departing from the spirit and scope of the invention.

What is claimed is:

1. A method for masking door hinges during painting, the method comprising the steps of:

a) providing a plurality of separate hinge plate masks and pin masks each respectively shaped and dimensioned to mask hinge plate and pin portions of a door hinge, each mask having a bottom surface provided with a releasable adhesive and in which the hinge plate masks and the pin masks are releasably disposed upon a transfer sheet;

b) removing a pair of the hinge plate masks and one of the pin masks from the transfer sheet and applying said masks in an overlapping relationship over the respective portions for which they are shaped and dimensioned of one door hinge prior to painting; and then c) removing the masks after painting.

2. The method recited in claim 1 further comprising the step of forming a tab extending from each mask to facilitate the removal of each mask after painting.

3. The method recited in claim 2 wherein the disposing step further comprises:

first placing the pin mask across the hinge pin portion of the door hinge; and then placing the hinge masks over the hinge plate portions of the door hinge and overlapping the pin mask.

4. The method recited in claim 3 wherein the removal step comprises pulling the pin mask and both hinge masks away from the door hinge using a tab extending from the pin mask.

5. The method recited in claim 1 further comprising the step of forming the hinge masks and the pin mask from a sheet material.

6. The method recited in claim 5 further comprising the step of applying identifying printed matter to an upper surface of each hinge mask and each pin mask.

7. The method recited in claim 6 further comprising the step of printing alignment striations on the upper surface of each hinge mask.

8. The method recited in claim 5 further comprising the step of disposing two hinge masks and one pin mask as a unit on the transfer sheet.

9. The method recited in claim 8 further comprising the step of forming lateral perforations across the transfer sheet between adjacent units to permit easy removal of units from the transfer sheet.

10. The method recited in claim 9 further comprising the steps of:

providing plural barrel masks, each shaped and dimensioned to mask the barrel portion of a door hinge;

releasably disposing at least one barrel mask with each transfer sheet unit;

placing a barrel mask over the barrel portion of the door hinge before painting; and removing the hinge plate, pin and barrel masks after painting.

11. The method recited in claim 1 further comprising the step of separately adjusting the location of each mask of the pair of hinge plate masks to cover a corresponding hinge plate over which each mask is placed.

12. The method recited in claim 1 further comprising the steps of:

first placing the pin mask across the hinge pin portion of the door hinge; and then placing the hinge masks over the hinge plate portions of the door hinge and overlapping the pin mask by separately adjusting the location of each mask of the pair of hinge plate masks to cover only a corresponding hinge plate over which each mask is placed.

13. A method for masking door hinges during painting, the method comprising the steps of:

a) providing plural sets of at least first, second and third masks of sheet material, each of the first, second and third masks shaped and dimensioned to mask first and second portions of a door hinge during painting, said masks being releasably disposed upon a transfer sheet organized together as a unit having lateral perforations across the transfer sheet between adjacent units, to permit removal of units from the transfer sheet;

b) severing individual units of first, second and third masks along the perforation lines and removing the first and second masks for placement over the respective portions of a door hinge during painting;

c) applying said removed first, second, and third masks in an overlapping relationship over the respective portions for which they are shaped and dimensioned of a door hinge prior to painting; and d) removing the masks after painting.

14. The method recited in claim 13 further comprising the step of forming a tab extending from each mask to facilitate removal after painting.

15. The method recited in claim 14 further comprising the step of applying identifying printed matter to an upper surface of each mask.

16. The method recited in claim 13 further comprising the steps of:

providing a plurality of fourth masks of sheet material shaped and dimensioned to mask a fourth portion of the door hinge during painting; and removing one of the fourth masks and applying it to the fourth portion of the door hinge.

17. The method recited in claim 13 further comprising the step of separately adjusting the location of each of the first and second masks of each set to cover only a corresponding hinge plate over which each first or second mask is placed.

18. The method recited in claim 13 further comprising the steps of:

first placing the third mask across a hinge pin portion of a door hinge; and then placing the first and second masks over hinge plate portions of the door hinge and overlying the third mask by separately adjusting the location of each first and second masks in order to cover only a corresponding hinge plate over which each of the first or second masks are placed.

* * * * *